US011523692B2

(12) United States Patent
Yager Grad et al.

(10) Patent No.: US 11,523,692 B2
(45) Date of Patent: Dec. 13, 2022

(54) WALL MOUNTS FOR PLAY YARDS

(71) Applicant: North States Industries, Inc., Blaine, MN (US)

(72) Inventors: Julie Ann Yager Grad, Deephaven, MN (US); Dean Weisbeck, Medina, MN (US); Steve Vergin, Blaine, MN (US)

(73) Assignee: North States Industries, Inc., Plymouth, MN (US)

( * ) Notice: Subject to any disclaimer, the term of this patent is extended or adjusted under 35 U.S.C. 154(b) by 1199 days.

(21) Appl. No.: 16/025,078

(22) Filed: Jul. 2, 2018

(65) Prior Publication Data

US 2019/0000241 A1 Jan. 3, 2019

Related U.S. Application Data

(60) Provisional application No. 62/528,183, filed on Jul. 3, 2017.

(51) Int. Cl.
*A47D 13/06* (2006.01)

(52) U.S. Cl.
CPC ..... *A47D 13/066* (2013.01)

(58) Field of Classification Search
CPC .... A47D 13/06; A47D 13/061; A47D 13/065; A47D 13/066; E06B 9/01; E06B 2009/015; E04H 17/17; E04H 17/18; E04H 17/185
See application file for complete search history.

(56) References Cited

U.S. PATENT DOCUMENTS

| | | | | |
|---|---|---|---|---|
| 2,587,120 | A * | 2/1952 | Dawson | A47D 13/065 5/99.1 |
| 2,774,080 | A * | 12/1956 | Randall | A47D 13/065 5/99.1 |
| 3,021,116 | A | 2/1962 | Querengesser | |
| 4,628,635 | A | 12/1986 | Maillard | |
| 5,544,870 | A | 8/1996 | Kelley et al. | |
| 6,027,104 | A | 2/2000 | Alexander et al. | |
| D422,367 | S | 4/2000 | Mishina | |
| 6,112,461 | A | 9/2000 | Cheng | |
| 6,123,321 | A | 9/2000 | Miller | |

(Continued)

OTHER PUBLICATIONS

Petsmart, "Extra Tall Flexi Metal Walk-Through Gate w/Small Pet Door and Extensions," © 1999-2013, 3 pages.

(Continued)

*Primary Examiner* — Jonathan P Masinick
(74) *Attorney, Agent, or Firm* — Merchant & Gould P.C.

(57) ABSTRACT

An example play yard can include: a plurality of side panels configured to be coupled to one another to form the play yard, with each of the plurality of side panels being plastic; a yard mount configured to be coupled to a free end of one of the plurality of side panels, the yard mount including a first side configured to be coupled to the free end and a second side including a plurality of tabs with each forming an aperture therein; and a wall mount configured to be coupled to a structure, the wall mount including a plurality of members. As the yard mount is moved relative to the wall mount, each one of the plurality of members of the wall mount is received in the aperture of each respective tab of the plurality of tabs of the yard mount to couple the yard mount to the wall mount.

19 Claims, 9 Drawing Sheets

(56) References Cited

U.S. PATENT DOCUMENTS

| | | | | |
|---|---|---|---|---|
| 6,161,334 | A * | 12/2000 | Goodin | E06B 9/0676 49/55 |
| 6,164,013 | A | 12/2000 | Ramsey | |
| 6,425,609 | B2 | 7/2002 | Cheng | |
| 6,446,395 | B2 | 9/2002 | Rogers | |
| 7,152,372 | B2 | 12/2006 | Cheng | |
| 7,207,141 | B2 | 4/2007 | Sullivan | |
| 7,234,275 | B1 * | 6/2007 | Haggy | E01F 15/088 256/26 |
| 7,284,502 | B1 | 10/2007 | Dotter | |
| 7,318,298 | B2 * | 1/2008 | Marsden | E06B 9/04 49/463 |
| 7,334,624 | B2 | 2/2008 | Waldman et al. | |
| 7,373,755 | B2 | 5/2008 | Jefferys et al. | |
| D577,465 | S | 9/2008 | Eren | |
| 7,481,471 | B2 | 1/2009 | Andersen et al. | |
| D608,019 | S | 1/2010 | Arden | |
| 7,887,029 | B2 | 2/2011 | Flannery | |
| 8,141,517 | B2 | 3/2012 | Shimoda et al. | |
| 8,176,962 | B2 | 5/2012 | Kilfoyle | |
| 8,286,591 | B2 | 10/2012 | Moffett-Chaney et al. | |
| 8,555,434 | B2 | 10/2013 | Chapman et al. | |
| 8,844,549 | B2 * | 9/2014 | Mohamed | E04H 15/02 5/99.1 |
| D714,960 | S * | 10/2014 | Weisbeck | D25/48.5 |
| 8,991,470 | B1 * | 3/2015 | Pacheco | A47D 13/066 160/350 |
| 9,097,050 | B2 | 8/2015 | Yates | |
| 9,215,860 | B2 * | 12/2015 | Hsieh | A01K 1/034 |
| 9,615,672 | B2 | 4/2017 | Weisbeck et al. | |
| 10,932,589 | B1 * | 3/2021 | Flannery | A47D 13/066 |
| 2004/0045222 | A1 | 3/2004 | Hicks | |
| 2004/0239122 | A1 | 12/2004 | Thompson | |
| 2006/0055182 | A1 | 3/2006 | Jefferys et al. | |
| 2006/0081826 | A1 | 4/2006 | Cheng | |
| 2006/0169217 | A1 | 8/2006 | Glassford | |
| 2006/0175028 | A1 | 8/2006 | Askinasi | |
| 2006/0207180 | A1 | 9/2006 | Cheng | |
| 2008/0185566 | A1 | 8/2008 | Flannery | |
| 2008/0265233 | A1 | 10/2008 | Flannery | |
| 2009/0013604 | A1 | 1/2009 | Yates | |
| 2011/0253963 | A1 | 10/2011 | Hsieh et al. | |
| 2012/0011775 | A1 | 1/2012 | Chen | |
| 2012/0235101 | A1 | 9/2012 | Flannery et al. | |
| 2012/0256148 | A1 | 10/2012 | Sirotin et al. | |
| 2013/0118088 | A1 | 5/2013 | Yates | |

OTHER PUBLICATIONS

Petsmart, "Iris 8 Panel Pet Containment Pen with door," © 1999-2013, 2 pages.

Petsmart, "Precision Pet Exercise Pen with Door-48" © 1999-2013, 2 pages.

Petsmart, "Primetime Petz Auto Close Pet Gate w/ Sub Door," © 1999-2013, 2 pages.

Petsmart, "Step-Over Mini Gate with Pet Door," © 1999-2013, 3 pages.

Petsmart, "Top Paw™ Extra-Wide Metal Walk Through Pet Gate," © 1999-2013, 3 pages.

Primetime Petz, "360° Configurable Gate w Door," © 2013, 4 pages.

Safety 1st®, "Baby & Pet Gate," © 2013, 4 pages.

* cited by examiner

WALL MOUNTS FOR PLAY YARDS

RELATED APPLICATION(S)

This patent application is related to U.S. Pat. No. 9,615,672 issued on Apr. 11, 2017, the entirety of which is hereby incorporated by reference.

BACKGROUND

A play yard forms an enclosed space in which young children and/or animals can be placed for security and safety. A typical play yard is made up of several panels and can be self-supporting. In some instances, it may be desirable to form the play yard around certain structures to enhance the security of the children and/or animals.

SUMMARY

In one aspect, an example play yard can include: a plurality of side panels configured to be coupled to one another to form the play yard, with each of the plurality of side panels being plastic; a yard mount configured to be coupled to a free end of one of the plurality of side panels, the yard mount including a first side configured to be coupled to the free end and a second side including a plurality of tabs with each forming an aperture therein; and a wall mount configured to be coupled to a structure, the wall mount including a plurality of members. As the yard mount is moved relative to the wall mount, each one of the plurality of members of the wall mount is received in the aperture of each respective tab of the plurality of tabs of the yard mount to couple the yard mount to the wall mount.

DETAILED DESCRIPTION

The present disclosure is directed towards a gate for a play yard. Examples are provided herein. However, the disclosure is not limited to the examples.

Figure 1:
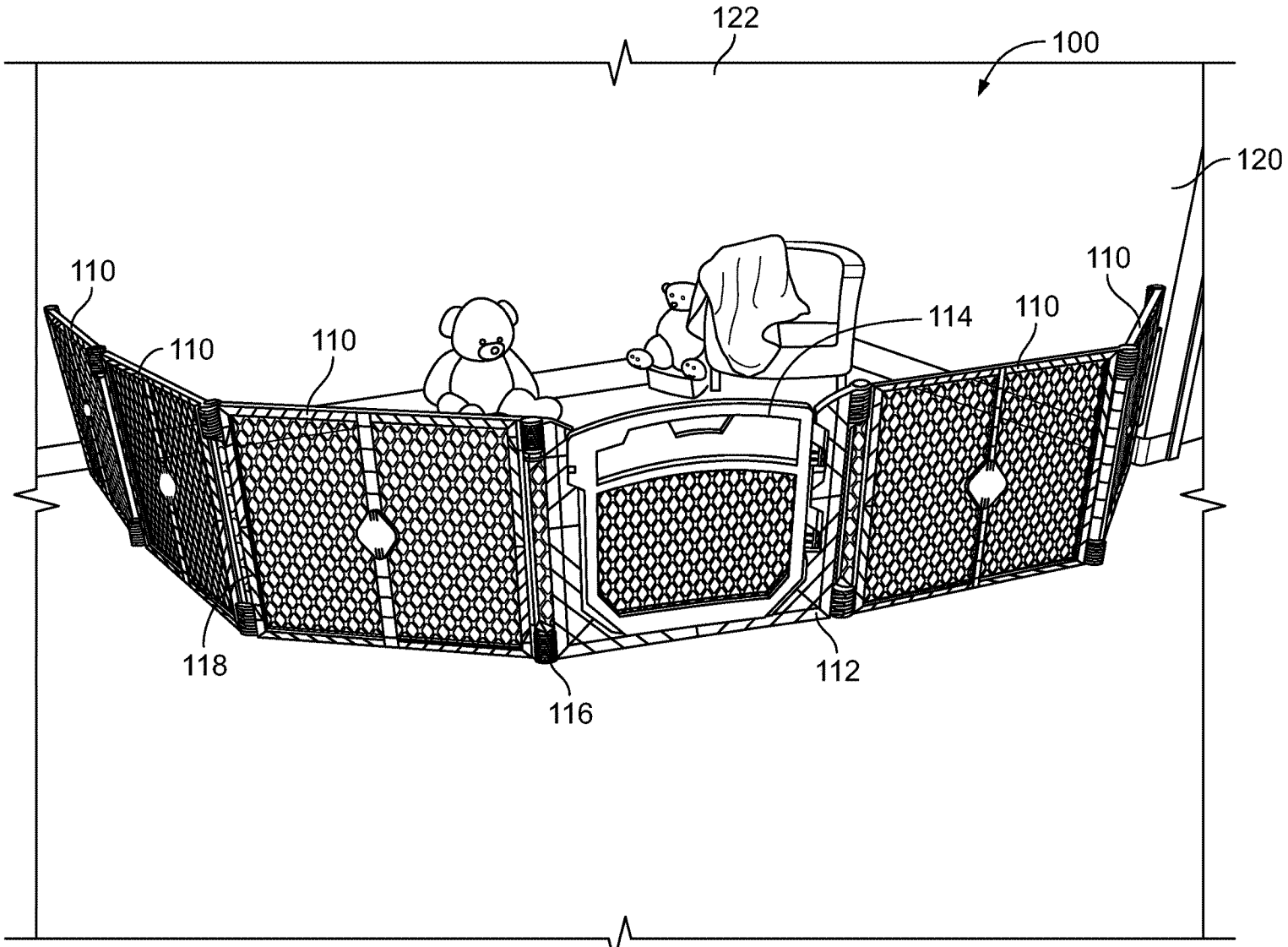
FIG. 1 shows an example play yard.

Referring now to FIG. 1, an example play yard 100 is shown. In this example, the play yard 100 includes a plurality of panels.

All but one of the panels in this example are identical and are referred to herein as side panels 110. There are five side panels 110 in the play yard 100, although more or fewer side panels can be provided. The side panels 110 are connected by hinges 116 and rods 118 to form five of the six sides of the play yard 100.

The other panel is similar to the side panels 110, except the panel includes an optional gate 114 and is referred to herein as a gate panel 112. The gate panel 112 connects to the other side panels 110 in a similar fashion. The gate 114 of the gate panel 112 pivots between a closed position and an open position. In other embodiments (see FIGS. 4-7), the gate panel 112 can be eliminated and/or replaced by another side panel 110. Additional details regarding the gate panel 112 can be found in U.S. Pat. No. 9,615,672.

In some examples, the play yard 100 can form a free-standing gate structure. However, in the example shown in FIG. 1, the play yard 100 is coupled to one or more structures, such as walls 120, 122. In alternative embodiments, both ends of the play yard 100 can be coupled to the same wall.

The panels 110, 112 and walls 120, 122 together form an enclosed space into which a child and/or animal can be placed for security and safety. In other examples, the panels 110, 112 and the walls 120, 122 together from an enclosed space to exclude the child or animal, such as to keep the child or animal from a dangerous condition like a fireplace or stairway. The shape of the space can be varied by moving the panels 110, 112. In other examples, other numbers of panels and sizes/shapes of the enclosed space can be used.

The gate panel 112 can be used to access the enclosed space by opening the gate 114 to gain access into and out of the enclosed space formed by the panels 110, 112.

In examples, the play yard 100 is made of a plastic material. In alternative designs, other materials, such as wood or metal, can also be used.

Figure 2:
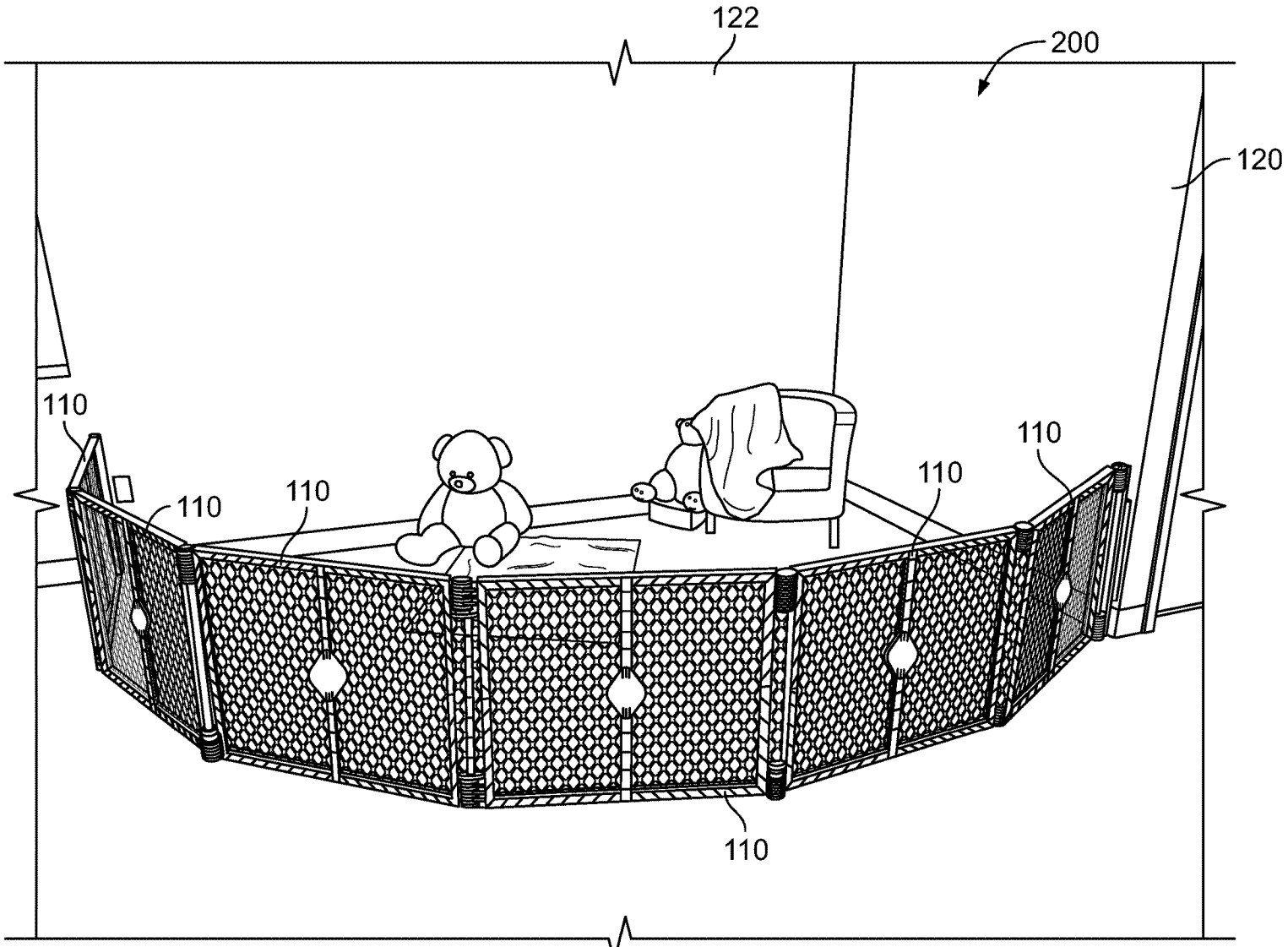
FIG. 2 shows another example play yard.
Figure 3:
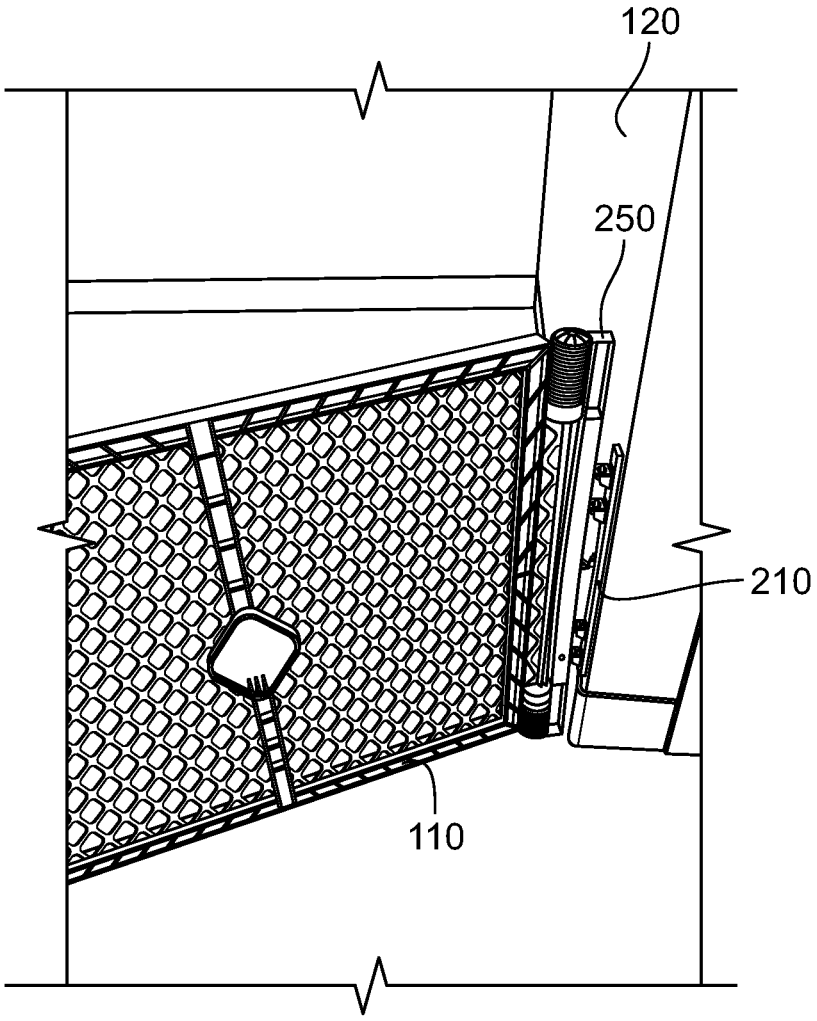
FIG. 3 shows a panel and wall mount of the play yard of FIG. 2.
Figure 4:
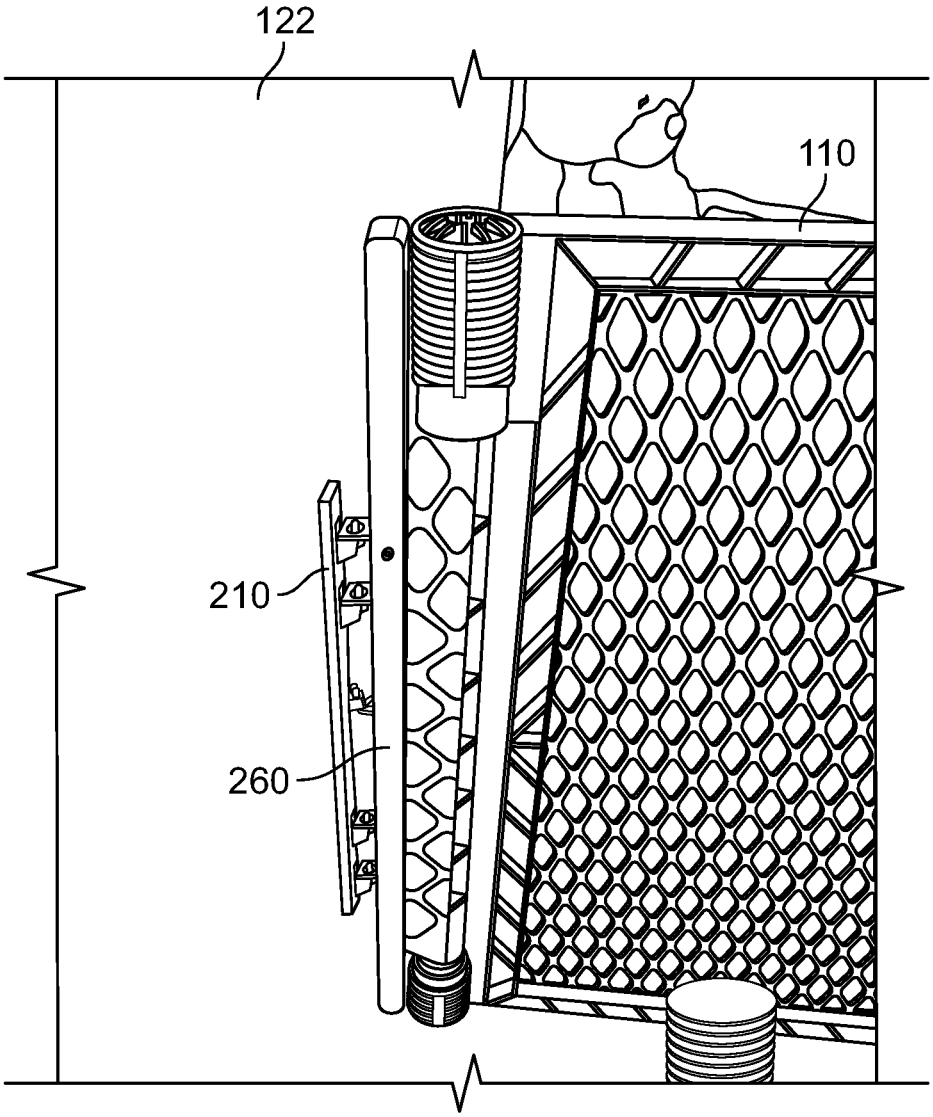
FIG. 4 shows another panel and wall mount of the play yard of FIG. 2.

Referring now to FIGS. 2-4, another example play yard 200 is shown. The play yard 200 is similar to the play yard 100 described above, except the play yard 200 does not include a gate panel. Instead, the play yard 200 has six side panels 110, although more or fewer panels can be provided.

As shown in FIG. 3, a wall mount 210 is coupled to the wall 120. The panel 110 is coupled to a hinge mount 250. The hinge mount 250 is, in turn, coupled to the wall mount 210 to couple the panel 110 to the wall 120.

Similarly, as shown in FIG. 4, an identical wall mount 210 is coupled to the wall 122. The panel 110 is coupled to rod mount 260. The rod mount 260 is, in turn, coupled to the wall mount 210 to couple the panel 110 to the wall 120. Additional details regarding the wall mount 210, the hinge mount 250, and the rod mount 260 are provided below.

In these examples, the wall mounts 210 are identical and interchangeable. In other examples, the wall mounts can be configured differently.

Figure 5:
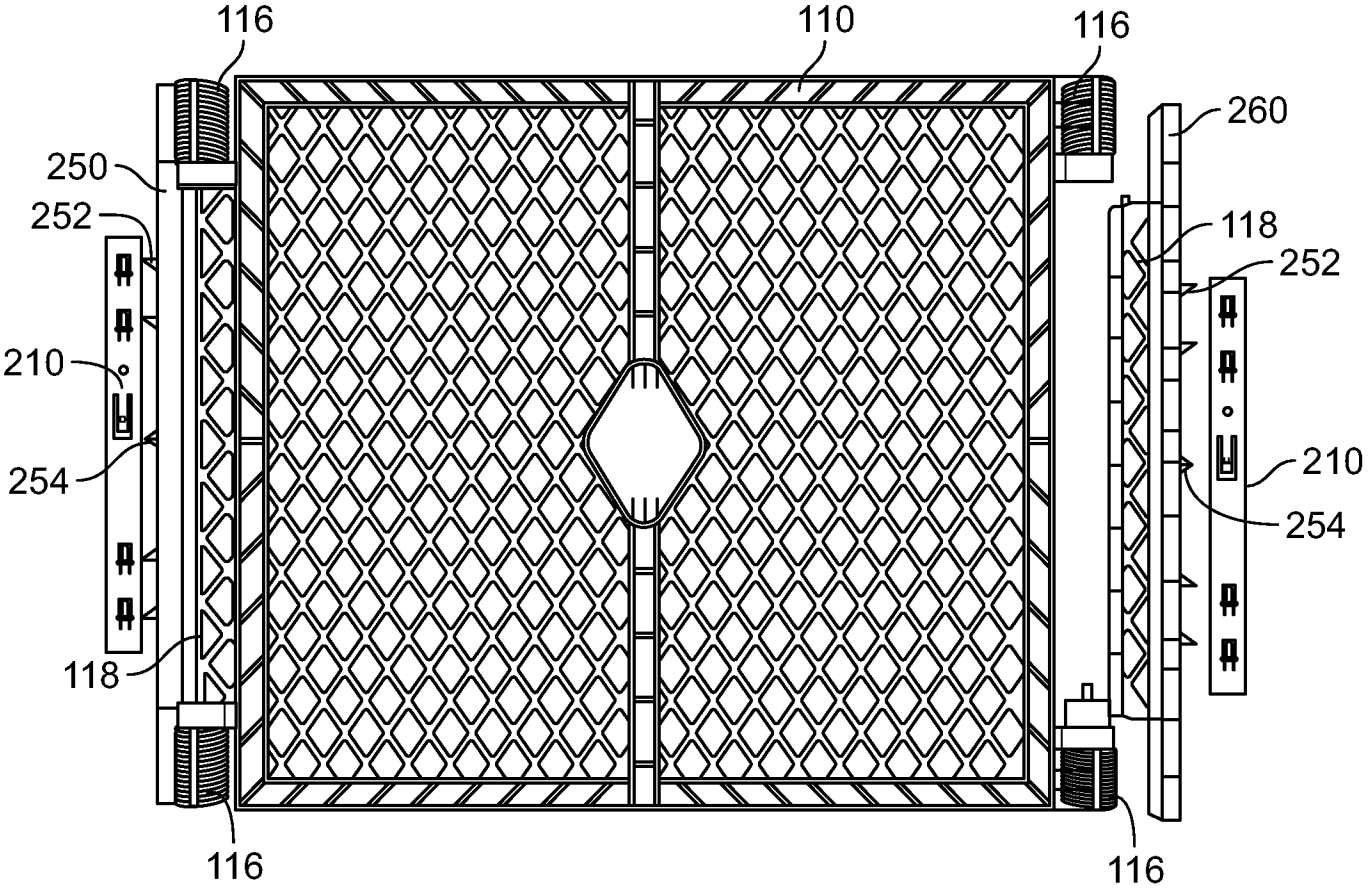
FIG. 5 shows a panel and wall mounts of the play yard of FIG. 2.
Figure 6:
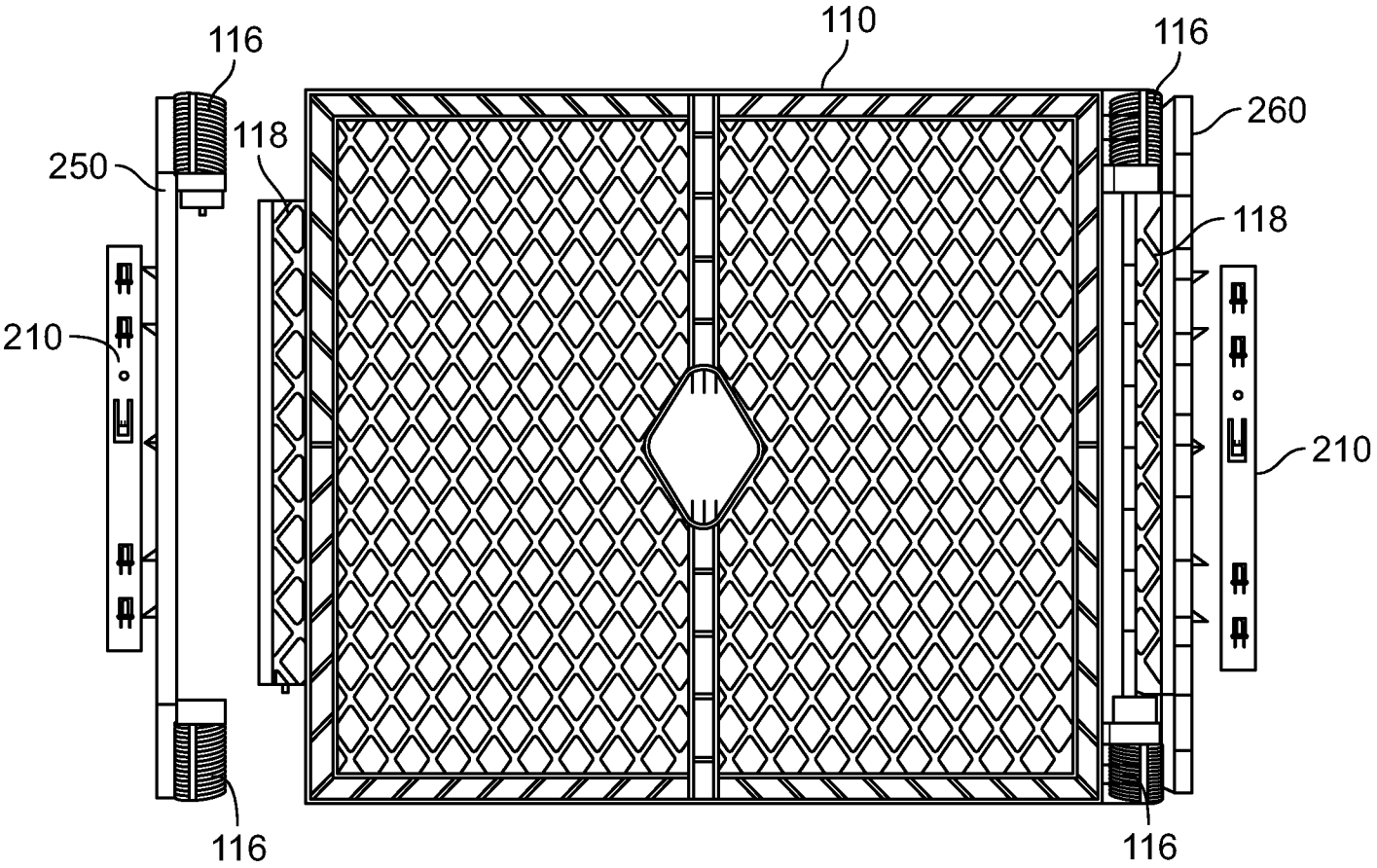
FIG. 6 shows the panel and wall mounts of FIG. 5.

Referring now to FIGS. 5-6, a single panel 110 is shown with the hinge mount 250 coupled to one side and the rod mount 260 coupled to the other side. In a typical scenario, the hinge mount 250 and the rod mount 260 would be coupled to different panels 110, rather than the single panel 110. There figures are for illustrative purposes.

In this example, the hinge mount 250 includes hinges 116 that are configured like the hinges 116 on the panels 110. The hinges 116 are configured to engage the rod 118 on the panel 110 to couple the hinge mount 250 to the panel 110 in the same manner that another panel 110 would be coupled to the depicted panel 110. When coupled, the hinge mount 250 can pivot relative to the panel 110. The hinge mount 250 also includes tabs 252 (four) and a lock member 254 that allow the hinge mount 250 to be coupled to the wall mount 210, as described further below.

The rod mount 260 includes a rod 118 that is configured like the rods 118 on the panels 110. The rod 118 is configured to engage the hinges 116 on the panel 110 to couple the rod mount 260 to the panel 110 in the same manner that another panel 110 would be coupled to the depicted panel 110. When coupled, the rod mount 260 can pivot relative to the panel 110. The rod mount 260 also includes tabs 252 (four) and a lock member 254 that allow the rod mount 260 to be coupled to the wall mount 210, as described further below.

Figure 8:
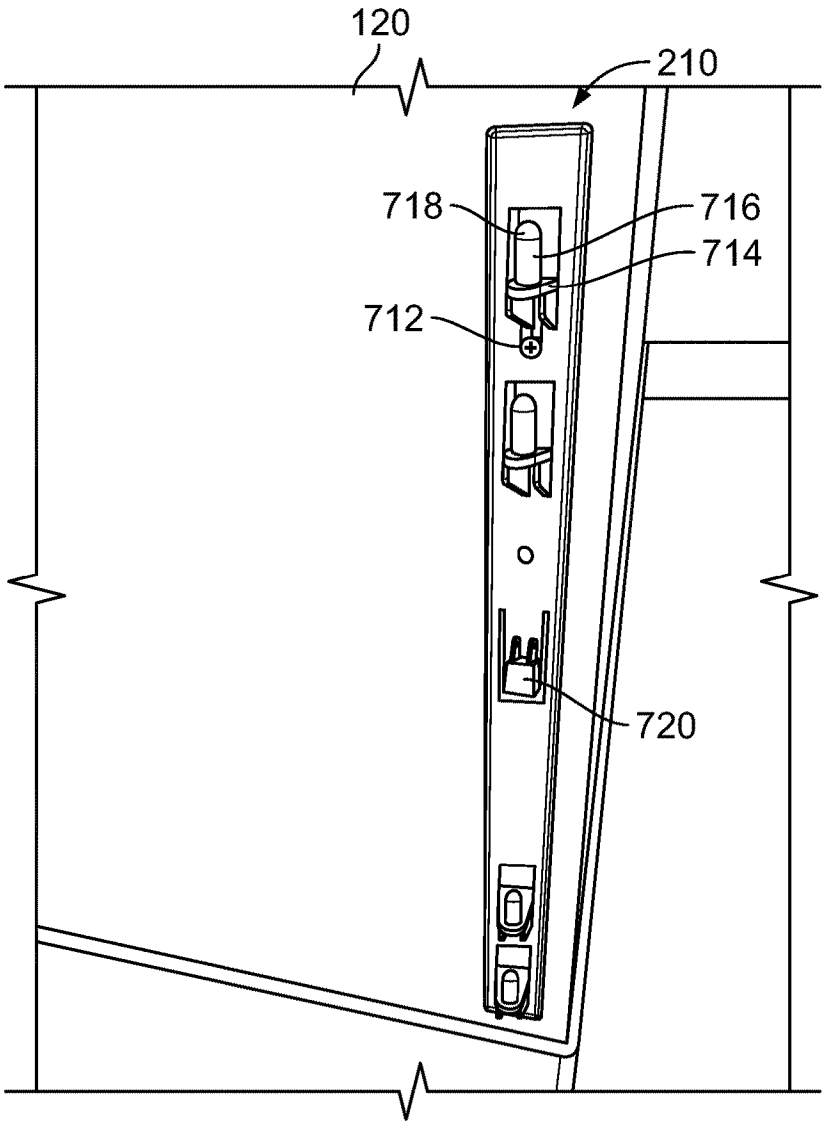
FIG. 8 shows the wall mount of FIG. 2.
Figure 7:
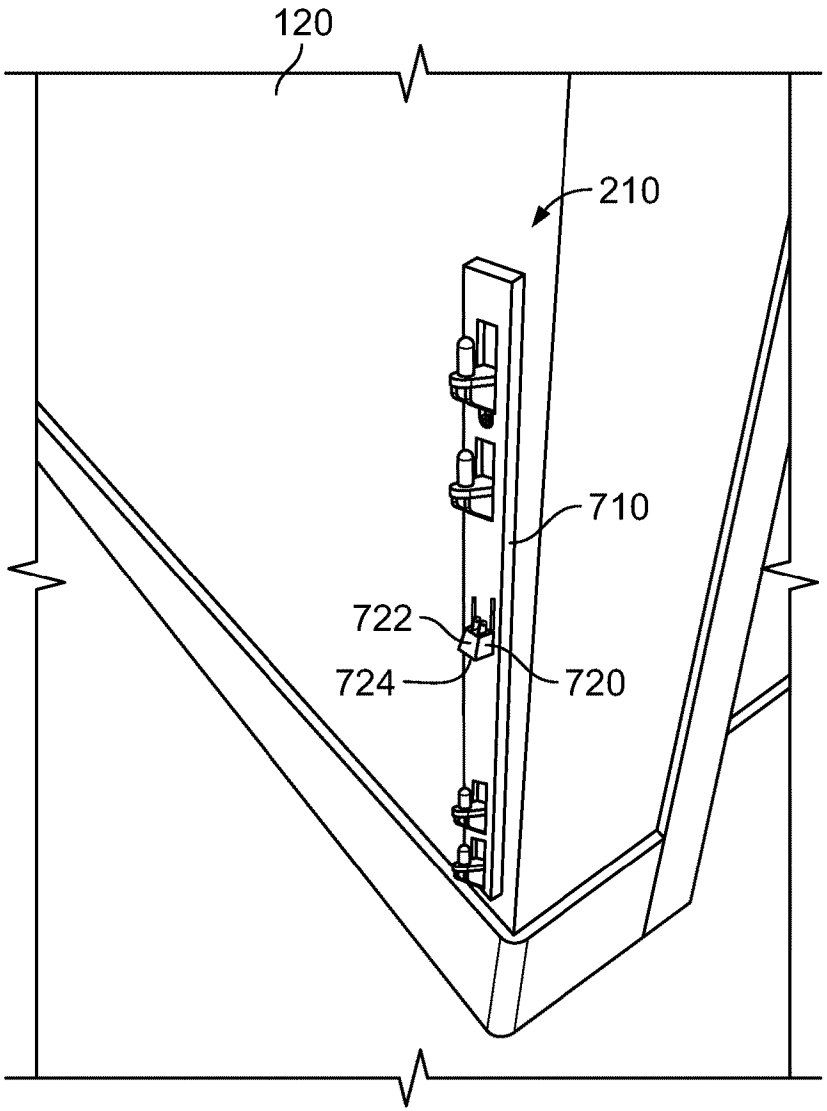
FIG. 7 shows the wall mount of FIG. 2.

Referring now to FIGS. 7-8, the wall mount 210 is shown in more detail. In this example, the wall mount 210 includes a main body 710 forming one or more apertures 712 through which fasteners, such as screws or nails, can be positioned to couple the wall mount 210 to a wall, such as the wall 120.

The wall mount 210 also includes four tabs 714 with mounts 716 extending therefrom. As described further below, the four tabs 714 are positioned to engage the tabs 252 of the hinge mount 250 or the rod mount 260. A tapered portion 718 of the mounts 716 facilitates this engagement. The wall mount 210 also includes a locking member 720 that is positioned to engage the lock member 254 of the hinge mount 250 or the rod mount 260. This is also described further below.

Figure 9:
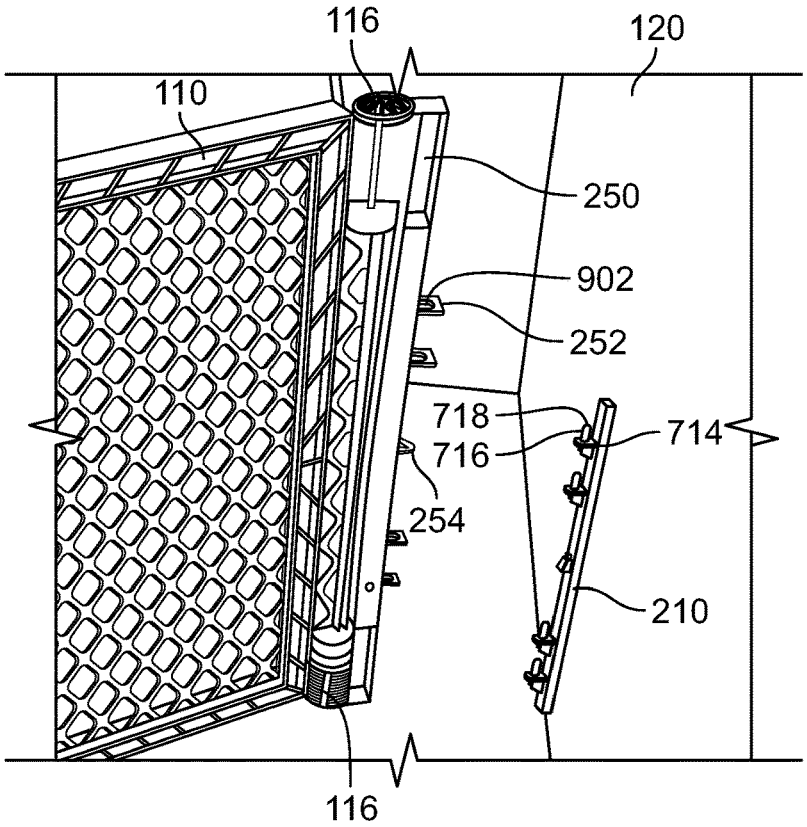
FIG. 9 shows a panel and wall mount of FIG. 2 in an uncoupled state.
Figure 10:
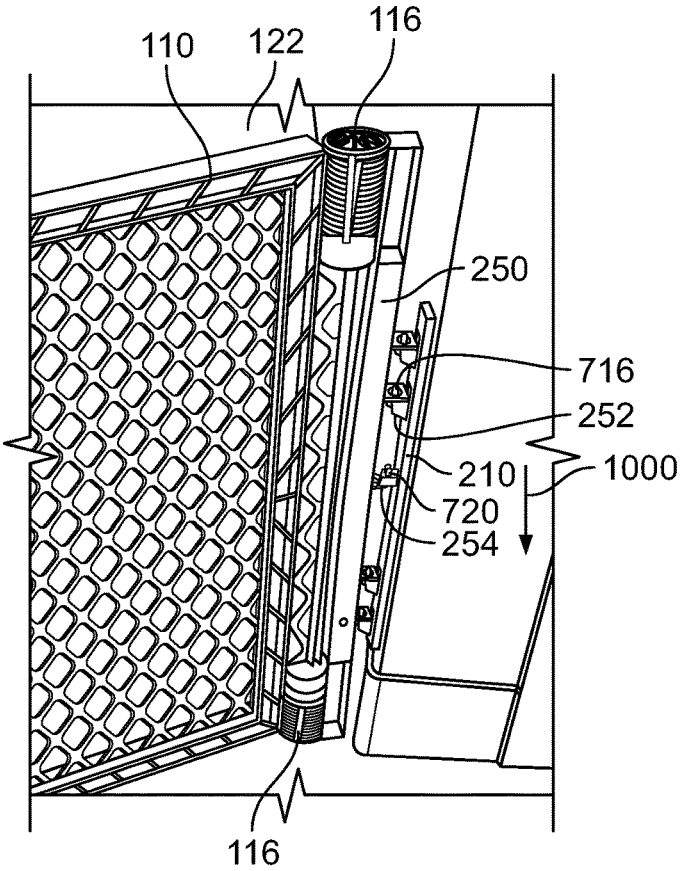
FIG. 10 shows the panel and the wall mount of FIG. 9 in a partially coupled state.

Referring now to FIGS. 9-10, the process for coupling the hinge mount 250 to the wall mount 210 is shown. A similar process is used to couple the rod mount 260 to the wall mount 210.

The hinge mount 250 (with the panel 110 if coupled thereto) is lifted slightly so that the tabs 252 are positioned over the mounts 716 on the tabs 714 of the hinge mount 250. An aperture 902 is formed in each of the tabs 252 to receive the mounts 716 as the hinge mount 250 is lowered onto the wall mount 210. The tapered portion 718 of each of the mounts 716 helps to center the mounts within each respective aperture 902.

As the hinge mount 250 is lowered in a parallel direction 1000, the lock member 254 of the hinge mount 250 engages the locking member 720. Specifically, a top surface 722 of the locking member 720 (see FIG. 7) is tapered so that, as the locking member 254 of the hinge mount 250 is lowered, the locking member 254 engages the top surface 722 of the locking member 720 and depresses the locking member 720 into the main body 710 of the wall mount 210 (i.e., towards the wall 120). This allows the locking member 254 of the hinge mount 250 to clear the locking member 720.

Once the locking member 254 of the hinge mount 250 is lowered past the locking member 720, the locking member 720 is biased (e.g., by a spring or other member positioned within the main body) into the outward locked position, as shown in FIG. 7. In this coupled position, a lower surface 724 of the locking member 720 engages the locking member 254 of the hinge mount 250 to resist the hinge mount 250 from being raised and thereby becoming uncoupled from the wall mount 210. The panel 110 can pivot relative to the hinge mount 250 about the hinges 116.

Figure 11:
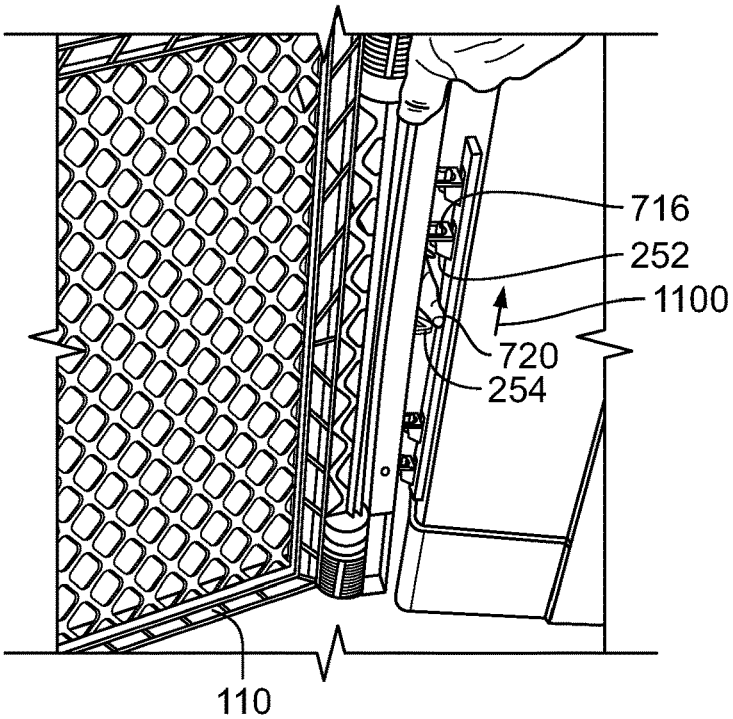
FIG. 11 shows the panel and the wall mount of FIG. 10 being uncoupled.
Figure 12:
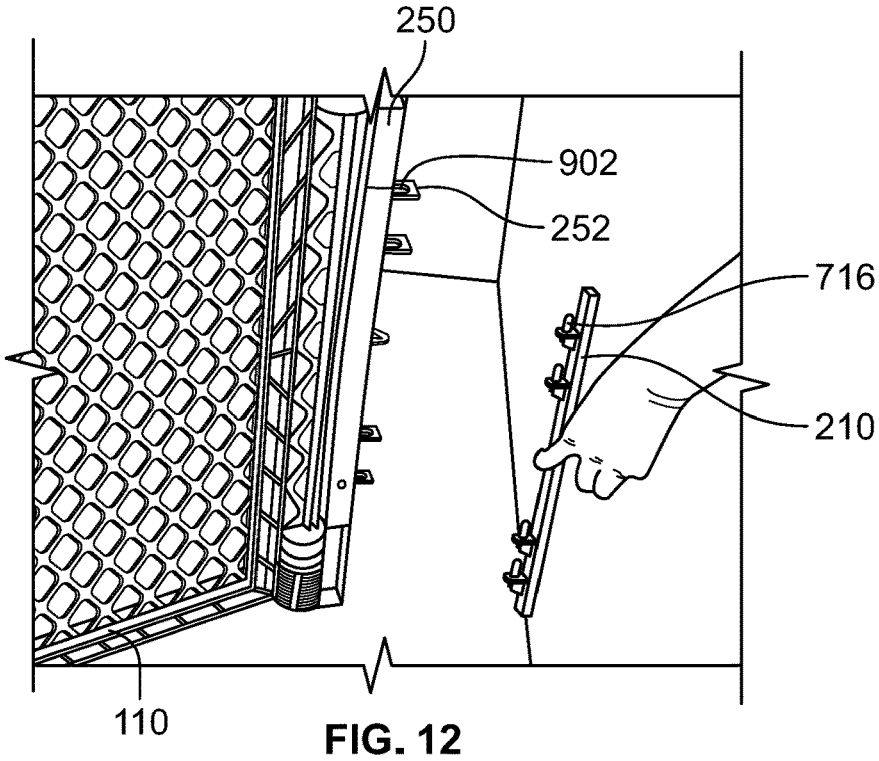
FIG. 12 shows the panel and the wall mount of FIG. 11 in the uncoupled state.

Referring now to FIGS. 11-12, the hinge mount 250 can be uncoupled from the wall mount 210. To do so, the locking member 720 is depressed (e.g., using a finger) into the main body 710 of the wall mount 210 (i.e., towards the wall 120). In this position, the locking member 254 of the hinge mount 250 can clear the locking member 720 as the hinge mount 250 is lifted relative to the wall mount 210 in a direction 1100. Once lifted, the tabs 252 of the hinge mount 250 clear the mounts 716. In this uncoupled position, the hinge mount 250 is uncoupled from the wall mount, as shown in FIG. 12.

Although each of the hinge mount 250 and the rod mount 260 and the wall mounts includes four tabs, more or fewer can be used. In this example, the tabs can be reinforced with additional material (e.g., thicker plastic) to help stabilize the play yard 100 relative to the walls 120, 122.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A play yard, comprising:

a plurality of side panels configured to be coupled to one another to form the play yard, with each of the plurality of side panels being plastic;

a yard mount configured to be coupled to a free end of one of the plurality of side panels, the yard mount including a first side configured to be coupled to the free end and a second side including a plurality of tabs with each forming an aperture therein; and a wall mount configured to be coupled to a structure, the wall mount including a plurality of members, wherein, as the yard mount is moved in a parallel direction relative to the wall mount, each one of the plurality of members of the wall mount is received in the aperture of each respective tab of the plurality of tabs of the yard mount to couple the yard mount to the wall mount, wherein:

the first side of the yard mount includes a hinge to be coupled to a rod of the free end of the one of the plurality of side panels; or the first side of the yard mount includes a rod to be coupled to a hinge of the free end of the one of the plurality of side panels.

2. The play yard of claim 1, further comprising:

a first locking member on the yard mount; and a second locking member on the wall mount;

wherein, as the yard mount is coupled to the wall mount, the first locking member depresses the second locking member until the first locking member clears the second locking member; and wherein, when the first locking member clears the second locking member, the second locking member is biased into a locked position to resist the yard mount from being uncoupled from the wall mount.

3. The play yard of claim 1, wherein each of the plurality of side panels is identical.

4. The play yard of claim 1, wherein the first side of the yard mount includes the hinge to be coupled to the rod of the free end of the one of the plurality of side panels.

5. The play yard of claim 1, wherein the first side of the yard mount includes the rod to be coupled to the hinge of the free end of the one of the plurality of side panels.

6. The play yard of claim 1, wherein the yard mount is a first yard mount, and further comprising a second yard mount configured to be coupled to a second free end of another one of the plurality of side panels.

7. The play yard of claim 6, wherein the wall mount is a first wall mount, and further comprising a second wall mount configured to be coupled to the structure.

8. The play yard of claim 1, wherein the wall mount defines a plurality of apertures through which fasteners are positioned to couple the wall mount to the structure.

9. A structure for enclosing a space, the structure comprising:

at least one wall; and a play yard including:

a plurality of side panels configured to be coupled to one another to form the play yard, with each of the plurality of side panels being plastic;

a yard mount configured to be coupled to a free end of one of the plurality of side panels, the yard mount including a first side configured to be coupled to the free end and a second side including a plurality of tabs with each forming an aperture therein; and a wall mount configured to be coupled to the at least one wall, the wall mount including a plurality of members, wherein, as the yard mount is moved in a parallel direction relative to the wall mount, each one of the plurality of members of the wall mount is received in the aperture of each respective tab of the plurality of tabs of the yard mount to couple the yard mount to the wall mount, wherein:

the first side of the yard mount includes a hinge to be coupled to a rod of the free end of the one of the plurality of side panels; or the first side of the yard mount includes a rod to be coupled to a hinge of the free end of the one of the plurality of side panels.

10. The structure of claim 9, further comprising:

a first locking member on the yard mount; and a second locking member on the wall mount;

wherein, as the yard mount is coupled to the wall mount, the first locking member depresses the second locking member until the first locking member clears the second locking member; and wherein, when the first locking member clears the second locking member, the second locking member is biased into a locked position to resist the yard mount from being uncoupled from the wall mount.

11. The structure of claim 9, wherein each of the plurality of side panels is identical.

12. The structure of claim 9, wherein the first side of the yard mount includes the hinge to be coupled to the rod of the free end of the one of the plurality of side panels.

13. The structure of claim 9, wherein the first side of the yard mount includes the rod to be coupled to the hinge of the free end of the one of the plurality of side panels.

14. The structure of claim 9, wherein the yard mount is a first yard mount, and further comprising a second yard mount configured to be coupled to a second free end of another one of the plurality of side panels.

15. The structure of claim 14, wherein the wall mount is a first wall mount, and further comprising a second wall mount configured to be coupled to the at least one wall.

16. A method of forming a play yard with a structure, the method comprising:

coupling a plurality of side panels configured to be coupled to one another to form the play yard;

coupling a first side of a yard mount to a free end of one of the plurality of side panels;

coupling a wall mount to the structure; and moving the yard mount relative to the wall mount so that members of the wall mount are received in apertures formed by the yard mount to couple the yard mount to the wall mount, wherein the first side of the yard mount includes a hinge to be coupled to a rod of the free end of the one of the plurality of side panels.

17. The method of claim 16, further comprising:

as the yard mount is coupled to the wall mount, allowing a first locking member of the yard mount to depress a second locking member of the wall mount until the first locking member clears the second locking member; and when the first locking member clears the second locking member, biasing the second locking member into a locked position to resist the yard mount from being uncoupled from the wall mount.

18. The method of claim 16, further comprising forming each of the plurality of side panels to be identical.

19. The method of claim 16, wherein the yard mount is a first yard mount, and further comprising coupling a second yard mount to a second free end of another one of the plurality of side panels.

* * * * *